US010989222B2

(12) United States Patent
Oh

(10) Patent No.: US 10,989,222 B2
(45) Date of Patent: Apr. 27, 2021

(54) REFRIGERANT COMPRESSOR

(71) Applicants: Danfoss A/S, Nordborg (DK); Justin Jongsik Oh, Tallahassee, FL (US)

(72) Inventor: Justin Jongsik Oh, Tallahassee, FL (US)

(73) Assignee: DANFOSS A/S

( * ) Notice: Subject to any disclaimer, the term of this patent is extended or adjusted under 35 U.S.C. 154(b) by 25 days.

(21) Appl. No.: 16/060,438

(22) PCT Filed: Jul. 14, 2017

(86) PCT No.: PCT/US2017/042055
§ 371 (c)(1),
(2) Date: Jun. 8, 2018

(87) PCT Pub. No.: WO2018/038818
PCT Pub. Date: Mar. 1, 2018

(65) Prior Publication Data

US 2020/0173464 A1 Jun. 4, 2020

Related U.S. Application Data

(60) Provisional application No. 62/379,367, filed on Aug. 25, 2016.

(51) Int. Cl.
*F04D 29/56* (2006.01)
*F04D 19/02* (2006.01)
(Continued)

(52) U.S. Cl.
CPC ..... *F04D 29/563* (2013.01); *F01D 17/162* (2013.01); *F04D 19/02* (2013.01);
(Continued)

(58) Field of Classification Search
CPC ..... F04D 17/025; F04D 23/00; F04D 23/001; F04D 23/003; F04D 23/005;
(Continued)

(56) References Cited

U.S. PATENT DOCUMENTS 3,941,499 A * 3/1976 Kronogard ..... F01D 25/002 415/116
RE32,756 E * 9/1988 Mowill ..... F04D 27/0246 415/161
(Continued)

FOREIGN PATENT DOCUMENTS

CN 101571138 A 11/2009
DE 102011121925 6/2013
(Continued)

OTHER PUBLICATIONS

International Preliminary Report on Patentability for International Application No. PCT/US2017/042055 dated Mar. 7, 2019.
(Continued)

*Primary Examiner* — Richard A Edgar
(74) *Attorney, Agent, or Firm* — Carlson, Gaskey & Olds, P.C.

(57) ABSTRACT

One exemplary embodiment of this disclosure relates to a refrigerant compressor. The compressor includes an axial section having a plurality of blades and vanes and a centrifugal section having an impeller. The centrifugal section is arranged downstream of the axial section.

7 Claims, 4 Drawing Sheets

(51) Int. Cl.
*F04D 29/28* (2006.01)
*F25B 1/053* (2006.01)
*F01D 17/16* (2006.01)

(52) U.S. Cl.
CPC ..... *F04D 29/284* (2013.01); *F05D 2210/14* (2013.01); *F05D 2240/12* (2013.01); *F05D 2250/51* (2013.01); *F25B 1/053* (2013.01)

(58) Field of Classification Search
CPC .... F04D 29/563; F04D 29/284; F04D 29/684; F04D 19/02; F04D 17/10; F01D 17/162; F05D 2210/14; F05D 2240/12; F05D 2250/51; F25B 1/053
See application file for complete search history.

(56) References Cited

U.S. PATENT DOCUMENTS 7,708,519 B2 * 5/2010 Mignano ..... F02C 7/18 415/157
7,856,834 B2 12/2010 Haley
7,922,467 B2 * 4/2011 Swanson ..... F04D 25/0606 417/423.7
8,414,249 B2 * 4/2013 Nikpour ..... F04D 17/025 415/1
9,261,102 B2 * 2/2016 Gingter ..... F04D 17/12
9,382,911 B2 * 7/2016 Sun ..... F25B 1/053
2015/0128640 A1 * 5/2015 Sun ..... F25B 1/10 62/498
2015/0322952 A1 * 11/2015 Bertoneri ..... F04D 29/284 415/1
2016/0068731 A1 3/2016 Minor et al.
2017/0248154 A1 * 8/2017 Nakaniwa ..... F04D 29/053
2017/0260987 A1 * 9/2017 Onodera ..... F04D 29/462
2018/0223866 A1 * 8/2018 Koga ..... F04D 29/462

FOREIGN PATENT DOCUMENTS

EP 0887557 12/1998
LU 34302 4/1956
WO 2009105602 A1 8/2009
WO 2015122991 8/2015

OTHER PUBLICATIONS

Cooling Post, DuPont's new HFO could replace R123. Apr. 22, 2014. Retrieved from the Internet: https://www.coolingpost.com/world-news/duponts-new-hfo-could-replace-r123/, entire document. Retrieved Jun. 5, 2018.
International Search Report and Written Opinion for International Application No. PCT/US2017/042055, dated Sep. 22, 2017.
Extended European Search Report for EP Application No. 17844073.1 dated Mar. 2, 2020.

* cited by examiner

REFRIGERANT COMPRESSOR

RELATED APPLICATIONS

This application claims the benefit of U.S. Provisional Application No. 62/379,367, filed Aug. 25, 2016, which is herein incorporated by reference in its entirety.

BACKGROUND

This disclosure relates to a compressor, such as for use in refrigeration.

Refrigerant compressors are used to circulate refrigerant in a chiller via a refrigerant loop. Refrigerant loops are known to include a condenser, an expansion device, and an evaporator. The compressor compresses the fluid, which then travels to a condenser, which cools and condenses the fluid. The refrigerant then goes to an expansion device, which decreases the pressure of the fluid, and to the evaporator, where the fluid is vaporized, completing a refrigeration cycle.

Environmental regulations have led to refrigerants with lower working pressure being preferred in minimizing the global warming potential and the ozone depletion potential. These lower working pressure refrigerants have a lower vapor density than higher working pressure refrigerants, requiring a larger cross-section area in order to pass the same mass flow rate. This larger cross-section area leads to bigger machine sizes and lower shaft speeds than machines that use higher working pressure refrigerants.

SUMMARY

An example refrigerant compressor according to an exemplary aspect of this disclosure includes an axial section having a plurality of blades and vanes and a centrifugal or mixed-flow section having an impeller. The centrifugal or mixed-flow section is positioned downstream of the axial section.

In a further embodiment of the foregoing system, a flash vapor port is arranged upstream of the centrifugal section.

In a further embodiment of the foregoing system, an inlet guide vane is arranged upstream of the axial section.

In a further embodiment of the foregoing system, an inlet guide vane is arranged upstream of the centrifugal flow section and downstream of the axial section.

In a further embodiment of the foregoing system, the inlet guide vane is a variable inlet guide vane.

In a further embodiment of the foregoing system, a first inlet guide vane is arranged upstream of the axial section and a second inlet guide vane is arranged downstream of the axial section.

In a further embodiment of the foregoing system, a diffuser is arranged downstream of the centrifugal section.

In a further embodiment of the foregoing system, the refrigerant compressor is part of a chiller system.

In a further embodiment of the foregoing system, a flow path for a working fluid is defined by a hub and a casing.

In a further embodiment of the foregoing system, the working fluid is one of HFO-1233ZD, R123, DR-2, and HFO-1336MZZ.

In a further embodiment of the foregoing system, a deswirler row having a plurality of blades is arranged upstream of the centrifugal section.

An example refrigerant compressor according to an exemplary aspect of this disclosure includes an axial portion and a centrifugal portion arranged about an axis of rotation, and a fluid flowpath. The fluid flowpath is substantially parallel to the axis of rotation at the axial portion, and the fluid flowpath is substantially perpendicular to the axis of rotation at a portion of the centrifugal portion.

In a further embodiment of the foregoing system, the axial portion comprises a plurality of blades and a plurality of vanes, and the centrifugal portion comprises an impeller In a further embodiment of the foregoing system, the centrifugal portion comprises a diffuser, and the fluid exits the flowpath via a volute.

In a further embodiment of the foregoing system, the fluid is a refrigerant.

In a further embodiment of the foregoing system, the refrigerant is one of HFO-1233ZD, R123, DR-2, and HFO-1336MZZ.

In a further embodiment of the foregoing system, a flash vapor port is arranged upstream of the centrifugal section.

In a further embodiment of the foregoing system, the compressor includes inlet guide vanes.

The embodiments, examples and alternatives of the preceding paragraphs, the claims, or the following description and drawings, including any of their various aspects or respective individual features, may be taken independently or in any combination. Features described in connection with one embodiment are applicable to all embodiments, unless such features are incompatible.

BRIEF DESCRIPTION OF THE DRAWINGS

The drawings can be briefly described as follows.

DETAILED DESCRIPTION

Figure 1:
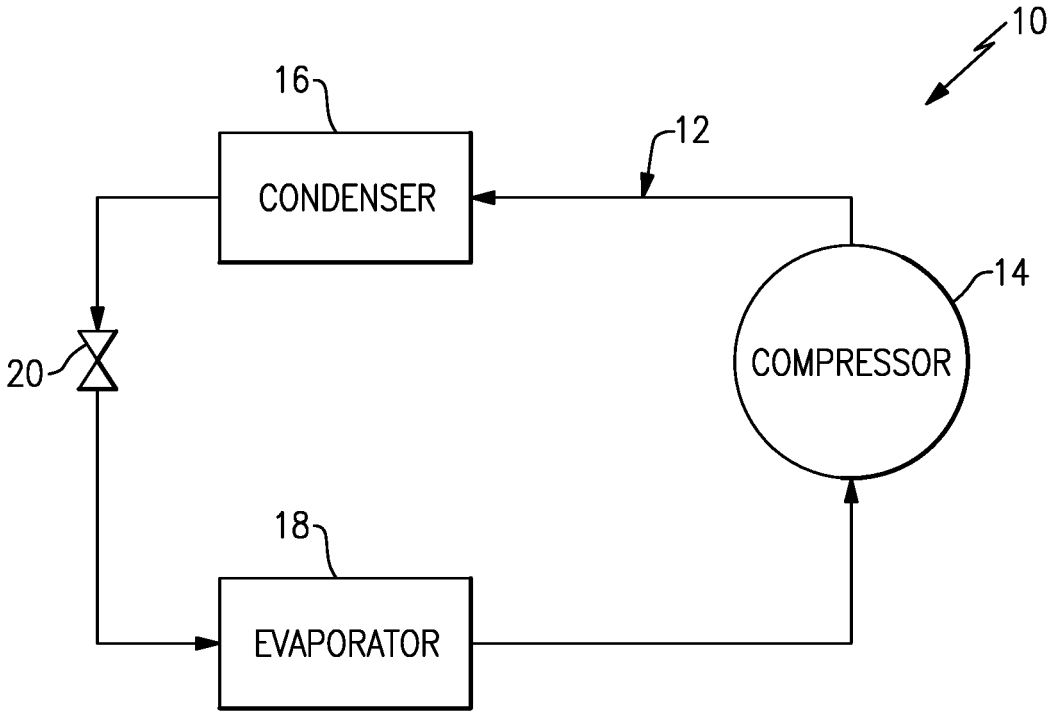
FIG. 1 shows a schematic illustration of a refrigerant loop.

FIG. 1 illustrates a refrigerant cooling system 10. The refrigerant system 10 includes a main refrigerant loop, or circuit, 12 in communication with a compressor 14, a condenser 16, an evaporator 18, and an expansion device 20. This refrigerant system 10 may be used in a chiller, for example. Notably, while a particular example of the refrigerant system 10 is shown, this application extends to other refrigerant system configurations. For instance, the main refrigerant loop 12 can include an economizer downstream of the condenser 16 and upstream of the expansion device 20.

The refrigerant cooling system 10 circulates a refrigerant. Increasingly, refrigerants with lower working pressure are preferred for environmentally-friendly reasons. Lower working pressure refrigerants also offer benefits in system efficiency, flammability, and toxicity. A lower working pressure refrigerant has a lower vapor pressure level, lower saturation pressure, and lower density than traditional refrigerants, such as HFC-134a or HFO-1234ZE. Lower working pressure refrigerants consequently require higher volumetric flow. Examples of such lower working pressure refrigerants include R123, HFO-1233ZD, HFO-1336MZZ, and DR-2. In an embodiment, lower working pressure refrigerants have a saturation vapor pressure below 100 kilopascals (kPa) (or about 14.5 psia) at 4.4 degrees Celsius (or about 40 degrees Fahrenheit). In another embodiment, lower working pressure refrigerants include refrigerants with a liquid phase saturation pressure below 45 pounds per square inch absolute (psia) (or about 310 kPa) at 104 degrees Fahrenheit (40 degrees Celsius), as defined by the Environmental Protection Agency's Refrigerant Recycling Regulations.

Figure 2:
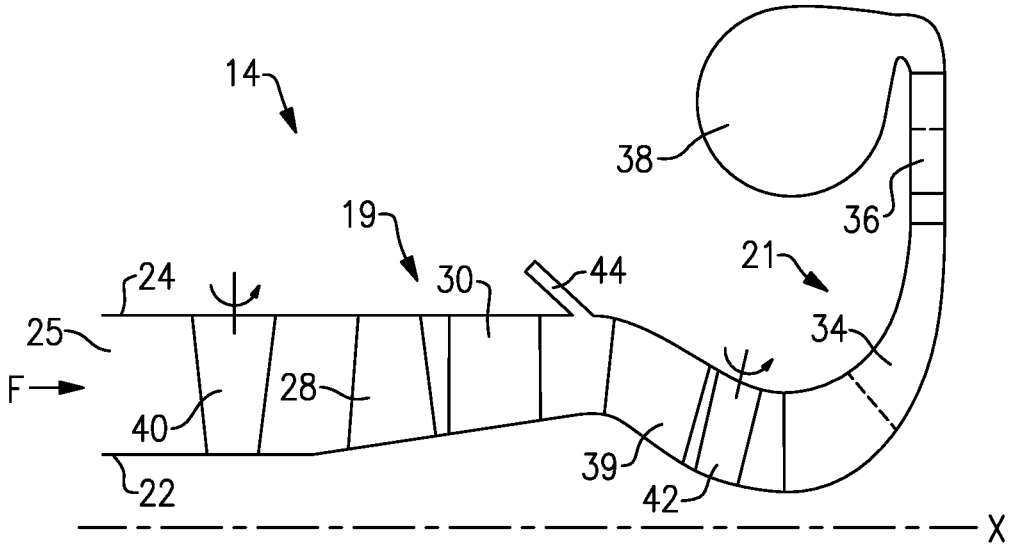
FIG. 2 shows a refrigerant compressor.

FIG. 2 illustrates an example refrigerant compressor 14 for a lower working pressure refrigerant. In this example, the compressor 14 includes an axial compressor section 19 and a centrifugal compressor section 21 arranged about an axis of rotation X. A fluid flow path F is bounded by a hub 22 at an interior and a shroud or casing 24 at an exterior. An inlet 25 of the compressor 14 receives fluid F from the evaporator 18. At the inlet 25, the fluid is flowing substantially parallel to the axis of rotation X. In this example, a first stage of the compressor 14 is a single-stage axial-flow section 19. The single-stage axial-flow section 19 includes a rotor row 28 having an array of rotor blades, and a stator row 30 having an array of stator vanes. The blades of the rotor row 28 are configured to provide a desired compression ratio. In an embodiment, the blades could include tip treatments, such as shrouds to help manage blade tip performance loss. The rotor row 28 elevates vapor enthalpy.

The stator row 30 elevates vapor static pressure and changes vapor swirl. The vanes of the stator row 30 are configured to remove the angular flow component imparted by the blades of the rotor row 28, and restore the axial flow direction as the working fluid F is directed downstream within the compressor 14. In one embodiment, the stator vanes may be stationary. In another embodiment, the stator row 30 may be radially adjusted, allowing for smooth transition of flow path F from the axial-flow section 19 without conventional return channel vanes. Together, the rotor row 28 and stator row 30 provide a single compression stage. It should be understood, however, that this disclosure extends to compressors having additional, or fewer, stages in the axial-flow compressor.

A centrifugal section 21 is arranged downstream of the axial-flow section 19 for second stage vapor compression. The centrifugal section 21 includes a centrifugal impeller 34. In an embodiment, the fluid flows radially outwardly at the centrifugal section 21. In other words, the fluid F flows substantially perpendicular to the axis X at a portion of the centrifugal section 21. The centrifugal impeller 34 could include full blades or a combination of full blades and splitter blades. In other embodiments, the centrifugal section 21 could include a single row or multiple rows of splitter blades. The addition of splitter blades may increase the flow capacity of the impeller 34. In a further embodiment, a diffuser 36 is arranged downstream of the impeller 34. The diffuser 36 could be a vaneless diffuser, a single row or multiple row vaned diffuser, or a pipe diffuser. A diffuser 36 may improve capacity control during various operating conditions, as well as the stable operating range of the compressor 14, which may result in higher compressor efficiency. After passing the diffuser 36, fluid F exits the compressor 14 via a volute 38, and goes on to the condenser 16. In other embodiments, a simple collector or axial exit flowpath could replace the volute 38. In some embodiments, a mixed-flow compressor could replace the centrifugal section 21 depending on design specifications. A mixed-flow compressor includes an impeller that combines axial and radial components to have a diagonal fluid flow. A mixed-flow compressor may allow for a smaller diameter shroud or casing 24.

In some embodiments, a deswirler row 39 is arranged upstream of the centrifugal section 21. The deswirler row 39 includes multiple blades and removes additional swirl flow prior to the fluid flow F entering the centrifugal section 21. In some embodiments, the compressor 14 includes an inlet guide vane 40 upstream of the axial-flow section 19. The inlet guide vane 40 may be stationary or variable. In a further embodiment, the inlet guide vane 40 is a single variable inlet guide vane. In other embodiments, the compressor 14 includes a single variable inlet guide vane 42 between the axial-flow section 19 and the centrifugal section 21. The inlet guide vane 42 may be arranged to improve system efficiency and stability by imparting either a rotational velocity component to manage the first stage incidence angle, or to expand the working fluid F to a higher specific volume, or both. Although two inlet guide vanes 40, 42 are illustrated, the compressor 14 could include more or fewer inlet guide vanes.

In a further embodiment, a flash vapor port 44 is arranged upstream of the centrifugal impeller 34. The vapor port 44 adds a small amount of flash vapor from the economizer to the flow path F, which improves refrigeration cycle efficiency.

Figure 3:
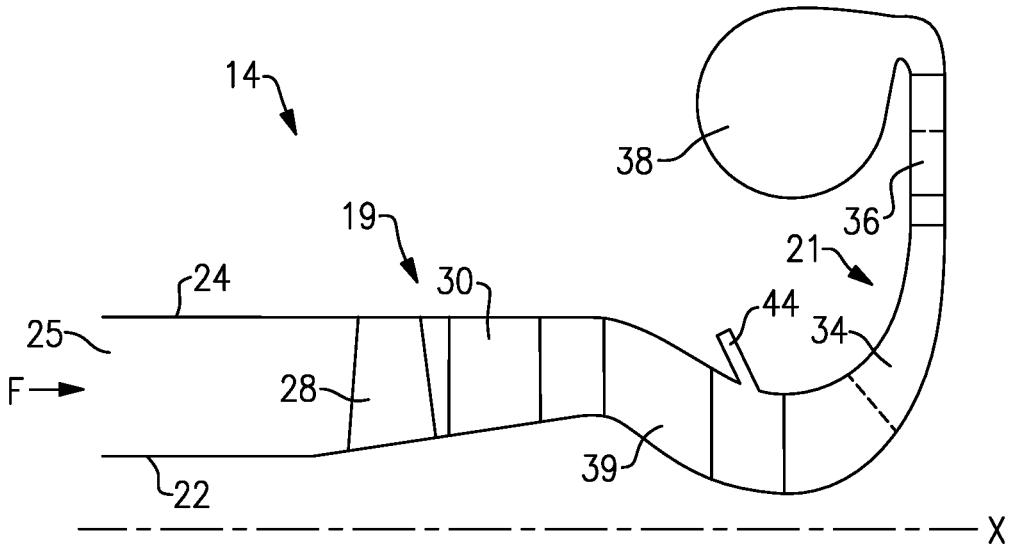
FIG. 3 shows another embodiment of a refrigerant compressor.

FIG. 3 illustrates another embodiment of a refrigerant compressor. In this embodiment, the vapor port 44 is arranged downstream of the deswirler row 39 and upstream of the centrifugal section 21. The illustrated embodiment does not include inlet guide vanes, but some embodiments could include inlet guide vanes upstream of the axial-flow section 19 and/or the centrifugal flow section 21.

Figure 4:
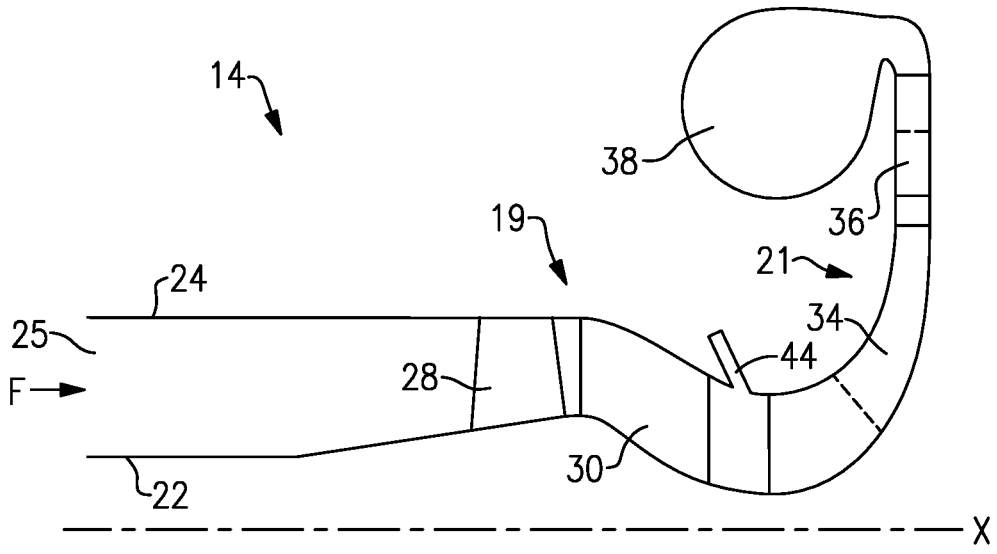
FIG. 4 shows another embodiment of a refrigerant compressor.

FIG. 4 illustrates another embodiment of a refrigerant compressor. In this embodiment, the compressor 14 does not include a deswirler row or inlet guide vanes.

Figure 5:
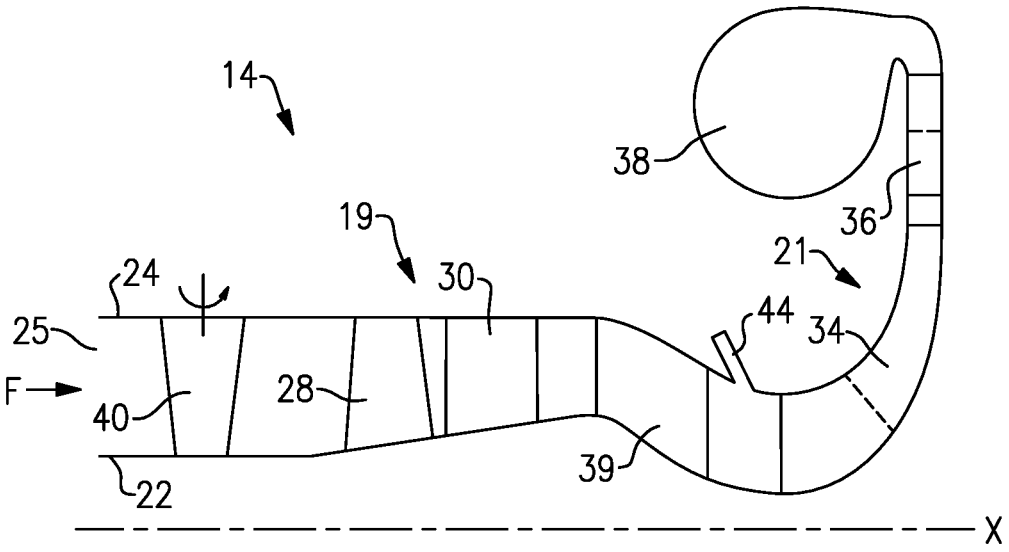
FIG. 5 shows another embodiment of a refrigerant compressor.

FIG. 5 illustrates another embodiment of a refrigerant compressor. In this embodiment, the compressor 14 includes a variable inlet guide vane 40 upstream of the axial-flow section 19. The vapor port 44 is arranged downstream of the deswirler row 39.

Figure 6:
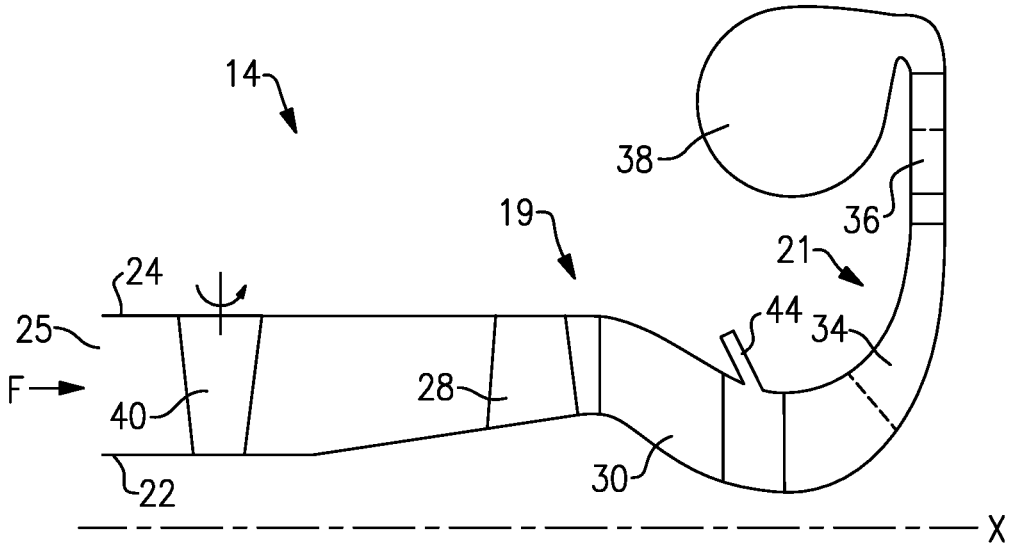
FIG. 6 shows another embodiment of a refrigerant compressor.

FIG. 6 illustrates another embodiment of a refrigerant compressor. In this embodiment, a variable inlet guide vane 40 is arranged upstream of the axial-flow section 19, and the compressor 14 does not include a deswirler row.

Figure 7:
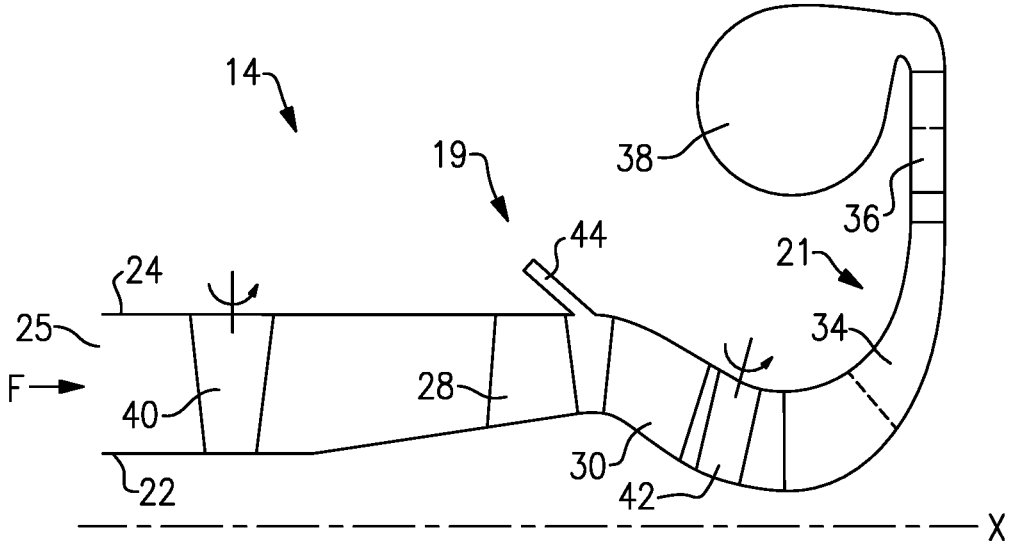
FIG. 7 shows another embodiment of a refrigerant compressor.

FIG. 7 illustrates another embodiment of a refrigerant compressor. In this embodiment, an inlet guide vane 40 is arranged upstream of the axial-flow section 19 and an inlet guide vane 42 is arranged downstream of the axial-flow section 19 but upstream of the centrifugal flow section 21. The vapor port 44 is arranged between the rotor row 28 and the stator row 30 of the axial-flow section 19.

These combinations of an axial-flow section 19 upstream of a centrifugal section 21 (or mixed-flow compressor) lead to a more compact compressor with higher shaft speeds using lower working pressure refrigerants. In some embodiments, the shaft speed is similar to shaft speeds of a conventional medium or higher working pressure refrigerant compressor. The more compact compressor additionally provides cost savings and the use of the lower working pressure refrigerant improves cycle efficiency.

It should be understood that terms such as "axial" and "radial", "centrifugal" or "mixed-flow" are used above with reference to the normal operational attitude of a compressor. Further, these terms have been used herein for purposes of explanation and should not be considered otherwise limiting. Terms such as "about" are not intended to be boundaryless terms, and should be interpreted consistent with the way one skilled in the art would interpret those terms.

Although the different examples have the specific components shown in the illustrations, embodiments of this disclosure are not limited to those particular combinations. It is possible to use some of the components or features from one of the examples in combination with features or components from another one of the examples.

One of ordinary skill in this art would understand that the above-described embodiments are exemplary and non-limiting. That is, modifications of this disclosure would come within the scope of the claims. Accordingly, the following claims should be studied to determine their true scope and content.

What is claimed is:

1. A refrigerant compressor, comprising a flow path for a working fluid defined by a hub and a casing;

an axial section having a plurality of blades and vanes along the flow path;

a centrifugal section having an impeller downstream of the axial section along the flow path;

an inlet guide vane arranged upstream of the centrifugal section and downstream of the axial section; and a flash vapor port arranged upstream of the centrifugal section, wherein the flash vapor port is arranged between the plurality of blades and the plurality of vanes.

2. The refrigerant compressor of claim 1, wherein a second inlet guide vane is arranged upstream of the axial section.

3. The refrigerant compressor of claim 2, wherein the second inlet guide vane is a variable inlet guide vane.

4. The refrigerant compressor of claim 1, wherein the inlet guide vane is a variable inlet guide vane.

5. The refrigerant compressor of claim 1, further comprising a diffuser downstream of the centrifugal section.

6. The refrigerant compressor of claim 1, wherein the refrigerant compressor is part of a chiller system.

7. The refrigerant compressor of claim 1, wherein the working fluid is one of HFO-1233ZD, R123, DR-2, and HFO-1336MZZ.

* * * * *